US012741222B2

(12) United States Patent
Mikulski et al.

(10) Patent No.: US 12,741,222 B2
(45) Date of Patent: Sep. 22, 2026

(54) SYSTEMS AND METHODS FOR A DYNAMIC MULTI-EXPERIENCE RIDE SYSTEM

(71) Applicant: Universal City Studios LLC, Universal City, CA (US)

(72) Inventors: Nathan Mikulski, Orlando, FL (US); Sarah Anne Kelley, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 492 days.

(21) Appl. No.: 18/327,300

(22) Filed: Jun. 1, 2023

(65) Prior Publication Data

US 2023/0405481 A1 Dec. 21, 2023

Related U.S. Application Data

(60) Provisional application No. 63/352,795, filed on Jun. 16, 2022.

(51) Int. Cl.

| | |
|---|---|
| ***A63G 7/00*** | (2006.01) |
| ***A63G 1/10*** | (2006.01) |
| ***B61J 1/08*** | (2006.01) |

(52) U.S. Cl.

CPC ..... *A63G 7/00* (2013.01); *A63G 1/10* (2013.01); *B61J 1/08* (2013.01)

(58) Field of Classification Search

CPC . A63G 1/10; A63G 7/00; A63G 31/00; A63G 31/02; A63G 31/16

See application file for complete search history.

(56) References Cited

U.S. PATENT DOCUMENTS

| | | | | |
|---|---|---|---|---|
| 7,484,460 | B2 | 2/2009 | Blum et al. | |
| 9,084,941 | B1 * | 7/2015 | Fram | A63G 7/00 |
| 2005/0098056 | A1 | 5/2005 | Roodenburg et al. | |
| 2018/0120862 | A1 | 5/2018 | Dembinski et al. | |
| 2019/0070515 | A1 | 3/2019 | Grogan et al. | |
| 2019/0161099 | A1 | 5/2019 | Burger | |
| 2020/0215444 | A1 | 7/2020 | Hall et al. | |
| 2020/0269888 | A1 | 8/2020 | Alarcon et al. | |
| 2020/0338462 | A1 | 10/2020 | Dagley | |

OTHER PUBLICATIONS

PCT/US2023/024616 Invitation to Pay Additional Fees mailed Sep. 20, 2023.

EP Office Action for European Application No. 23736527.5 mailed Feb. 16, 2026.

* cited by examiner

*Primary Examiner* — Robert J McCarry, Jr.

(74) *Attorney, Agent, or Firm* — Fletcher Yoder, P.C.

(57) ABSTRACT

An attraction system includes a ride vehicle motion system that includes a ride vehicle coupled to a motion base via a track element. The ride vehicle motion system is capable of motion along a first track or a surface of a first ride type using a transport base coupled to the motion base and capable of generating motion effects using the motion base while in motion along the track or surface. The ride vehicle motion system is also capable of moving to align the track element with a second track of a second ride type to permit the ride vehicle to separate from the ride vehicle motion system and traverse the second track.

18 Claims, 8 Drawing Sheets

SYSTEMS AND METHODS FOR A DYNAMIC MULTI-EXPERIENCE RIDE SYSTEM

CROSS-REFERENCE TO RELATED APPLICATIONS

This application claims priority to and the benefit of U.S. Provisional Application No. 63/352,795, entitled "SYSTEMS AND METHODS FOR A DYNAMIC MULTI-EXPERIENCE RIDE SYSTEM," filed Jun. 16, 2022, which is hereby incorporated by reference in its entirety for all purposes.

FIELD OF DISCLOSURE

The present disclosure relates generally to autonomous transportation techniques. More specifically, embodiments of the present disclosure relate to systems and methods for autonomous transportation of guests and materials within an entertainment site.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Theme parks and other such entertainment venues are becoming increasingly popular. Further, immersive experiences within such entertainment venues are in high demand. In order to provide new and exciting experiences, attractions, such as ride experiences and scenes (e.g., visual shows including live action, animated figures, computer-generated imagery, and so on) have become increasingly complex. In some instances, individual attractions may be dark rides, virtual reality (VR) rides, water rides, or coaster rides. Combining different types of attractions into a single ride experience may enhance a guest experience.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with an embodiment, an attraction system is provided that includes a ride vehicle motion system. The ride vehicle motion system includes a ride vehicle; a track element supporting the ride vehicle; a motion base configured to actuate to cause the ride vehicle and the track element to move, wherein the track element is positioned between the ride vehicle and the motion base; and a transport base supporting the motion base, wherein the transport base is configured to transport the ride vehicle, the track element, and the motion base as a unit along a first track or a surface associated with a first ride type. The attraction system also includes a second track configured to receive the ride vehicle from the track element, wherein the second track is associated with a second ride type.

In accordance with an embodiment, an attraction system is provided that includes a ride vehicle motion system. The multi-vehicle ride vehicle motion system includes a plurality of track elements, wherein at least one track element of the plurality of track elements supports a ride vehicle and a motion base configured to actuate to cause motion effects for the ride vehicle and to rotate the plurality of track elements about an axis of the motion base such that the ride vehicle and the at least one track element rotate together. The attraction system also includes a controller configured to generate instructions to control the motion base; and a track loop to receive the ride vehicle from the track element at an entry point of the track loop after rotation of the motion base to align the track element with the entry point, wherein, after the rotation, the controller causes the ride vehicle to move along the track element and onto the track loop.

In accordance with an embodiment, an attraction system is provided that includes a first track associated with a first ride type and a plurality of ride vehicles. The attraction system also includes a plurality of ride vehicle motion systems. Each ride vehicle motion system of the plurality may include a track element; a motion base configured to actuate to cause the track element to move; and a transport base supporting the motion base, wherein the transport base is configured to transport the track element, and the motion base as a unit along a second track or a surface associated with a second ride type. The attraction system also includes a controller that generates instructions to cause the plurality of ride vehicles to traverse the first track, cause a first ride vehicle motion system of the plurality to move to align the track element with an entry point of the first track, and cause a first ride vehicle of the plurality to move along the track element and onto the first track, and cause a second ride vehicle of the plurality to move from the first track onto an available vehicle slot of a second ride vehicle motion system.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
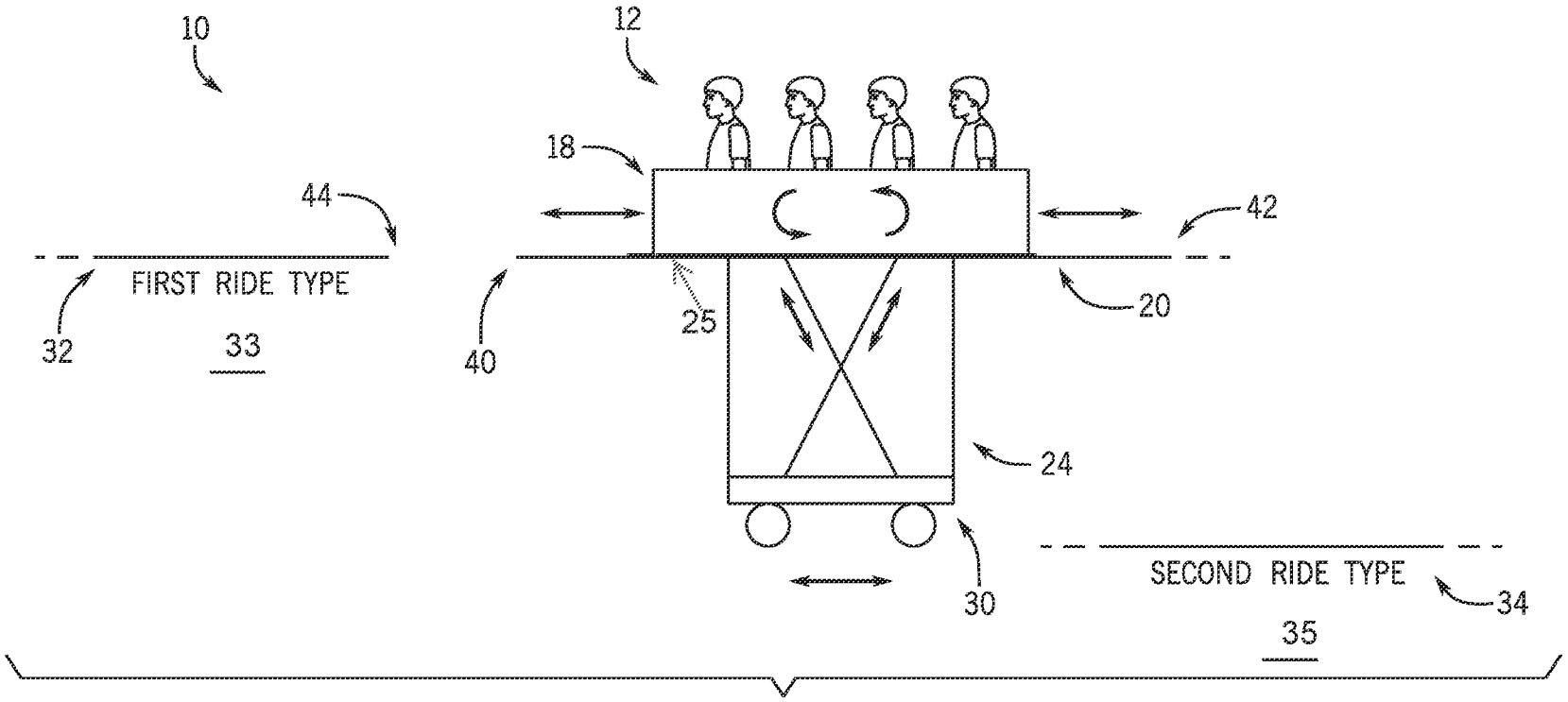
FIG. 1 is a schematic diagram of a vehicle motion system used in conjunction with an attraction, in accordance with an aspect of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Further, to the extent that certain terms such as parallel, perpendicular, and so forth are used herein, it should be understood that these terms allow for certain deviations from a strict mathematical definition, for example, to allow for deviations associated with manufacturing imperfections and associated tolerances.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Provided herein is a vehicle motion system that can be used in conjunction with a multi-experience attraction system. A ride vehicle can experience part of the multi-experience attraction system while coupled to the vehicle motion system, and the vehicle motion system can be used to move the ride vehicle with multiple degrees of freedom to create dynamic motion effects while moving through an attraction under power of the vehicle motion system. That is, the vehicle motion system itself can function as a transport vehicle to move the ride vehicle, while coupled to the vehicle motion system, within the attraction system as part of a ride. While acting as a transport vehicle, the actuation effects onboard the vehicle motion system are translated to the coupled ride vehicle, permitting the vehicle motion system to activate motion effects as part of a ride. The vehicle motion system may also be used to transport the ride vehicle to entry points of different experiences. At such entry points, the ride vehicle can separate from the vehicle motion system and enter into another ride type that the ride vehicle traverses uncoupled to the vehicle motion system.

Thus, while loaded into a single ride vehicle, guests can experience different ride types of a multi-experience attraction depending on whether the ride vehicle is coupled to the vehicle motion system or separate from the vehicle motion system and moving along a track. The disclosed embodiments allow the vehicle motion system to experience motion effects while moving through a first ride type, e.g., a dark ride section of the attraction. This is in contrast to certain arrangements in which the ride vehicle stays in a single location during motion effects that are linked to the ride track, which provides a less dynamic experience of the attraction.

FIG. 1 is a schematic view of a multi-experience attraction 10 that includes a vehicle motion system 12. The ride vehicle motion system 12 includes a ride vehicle 18 that can hold one or more guests, e.g., via seats, benches, harness, restraints, etc. The ride vehicle 18 is supported by a track element 20. The track element 20 is coupled to a motion base 24 that, when actuated, moves the track element 20 and, when present, concurrently moves a ride vehicle 18 positioned on the track element 20. Depending on the particular arrangement of the motion base 24, the track element 20 and ride vehicle 18 can be moved with six degrees of freedom based on different actuation instructions provided to the motion base 24. The motion base 24 includes a motion system (e.g., motion system 76, see FIG. 5 that may include actuators that are pneumatic, hydraulic, mechanical, electric, etc.) and is coupled to a transport base 30 (pinch drive, powered caster, carousel etc.). The track element 20, which includes a braking and vehicle retaining system, is then attached to the motion base 24. In embodiments, the track section includes vehicle movement system and associated components, such as friction wheels, pinch drives, linear induction motor, and/or a linear synchronous motor.

In certain embodiments, the motion base 24 can be actuated to move the track element 20 and ride vehicle 18 together with multiple degrees of freedom, including pitch, roll, and heave as well as surge, sway, and yaw, either alone or in combination with one another. The ride vehicle motion system 12 also includes a transport base 30 that, when activated, can move the entire vehicle motion system 12. The ride vehicle 18 may, in some cases, include a rotation plate 25 to permit rotation of the ride vehicle 18 relative to the track section. In certain embodiments, the motion base 24 may additionally or alternatively include a rotation plate 25 to rotate the track element 20 and any coupled ride vehicle 18. Thus, where both the ride vehicle 18 and the motion base 24 include a rotation plate 25, the ride vehicle 18 may rotate independently of the track element 20 on which it rests, which itself may be rotating in a same or different direction.

At a specified point in the attraction system 10, the track element 20 aligns with a track and the ride vehicle 18 is moved onto a different section of the attraction. The ride vehicle motion system 12, now empty, then moves on to receive another ride vehicle at a later specified point in the attraction system 10. The ride vehicle 18 can move along the track element 20 between a first end 40 and a second end 42 and, in certain cases, can move off of or separate from the ride vehicle motion system 12 and move onto a first track 32 of a first ride type 33, e.g., a dark ride or roller coaster. Additionally, the ride vehicle motion system 12 can be moved as a whole or as a unit within the attraction system 10 and, in some cases, onto a second track 34 of a second ride type 35. Thus, the ride vehicle 18 can be in a first configuration (see FIG. 2) independent of the ride vehicle motion system 12 or a second configuration (see FIG. 3) in association with the ride vehicle motion system 12.

Certain elements of the ride vehicle motion system 12 may remain coupled to one another when in use. For example, a transport base 30, the motion base 24, and the track element 20 may remain in association with one another in the first configuration and the second configuration. In an embodiment, transport base 30, the motion base 24, and the track element 20 are at least partially fixed relative to one another. The ride vehicle 18 can translate along the track element 20 between the first end 40 and the second end 42 of the track element 20 and, in certain cases, can move off of the track element 20 at either the first end 40 or the second end 42 if the track section is coupled to an adjacent track.

Figure 2:
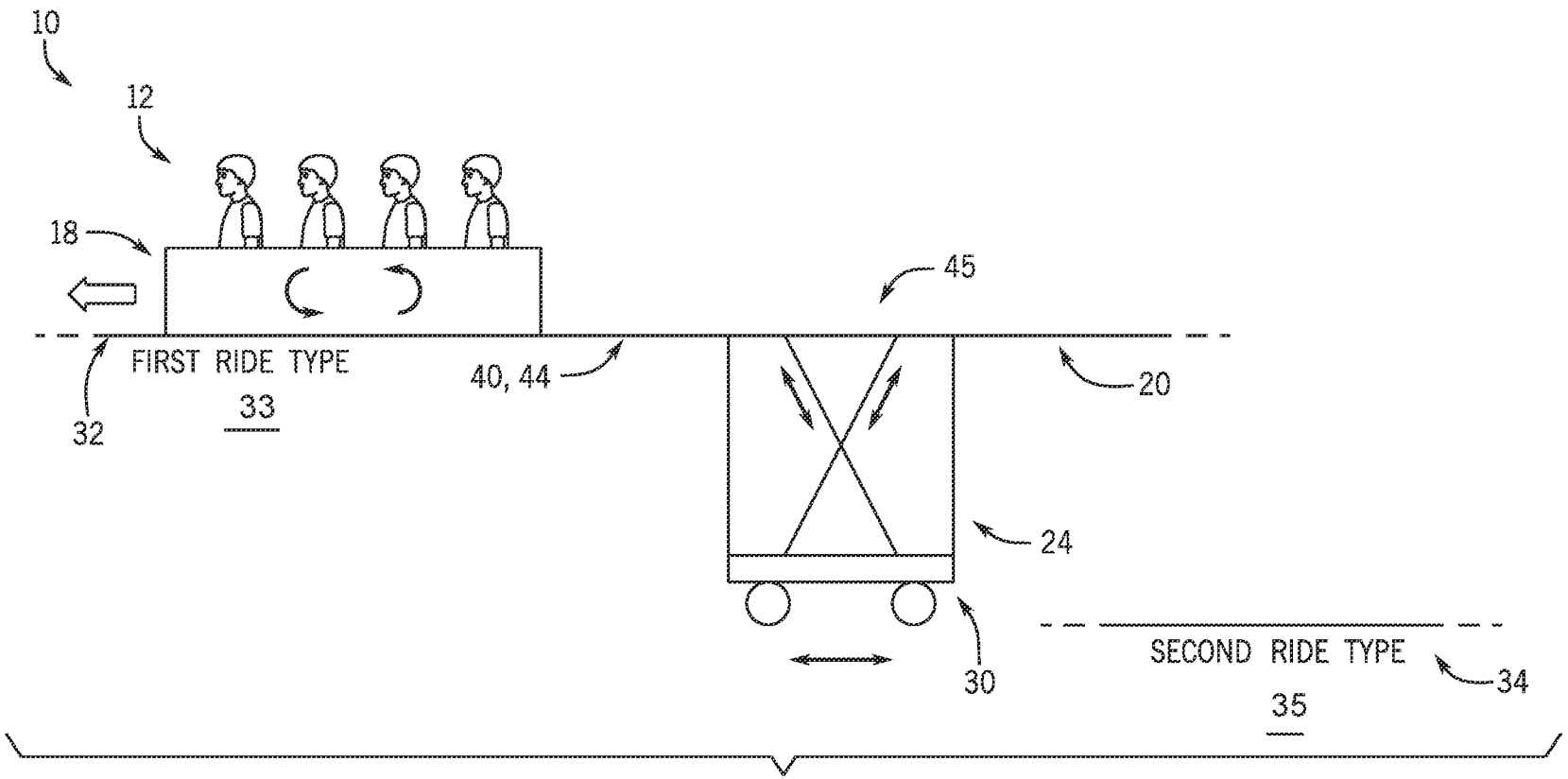
FIG. 2 shows a first configuration of the vehicle motion system of FIG. 1, in accordance with an aspect of the present disclosure.

For example, as seen in FIG. 2, in a first configuration, the ride vehicle motion system 12 can move within the attraction to position the first end 40 of the track element 20 next to a track end 44 of the first track 32 at an entry point of the first ride type 33. That is the first end 40 and the track end 44 can be joined at a reversible junction. Once in position, the vehicle motion system 12 can instruct the ride vehicle 18 to move along and off of the track element 20 to enter the first ride type 33 via the first track 32. While the ride vehicle 18 is traversing the first track 32 as part of the first ride type 33, the empty vehicle motion system 12 with an available ride vehicle slot 45 on the track element 20 can move away from the first track 32 to permit entry of another ride vehicle 18. Thus, the track element 20 and the first track 32 are separable from one another via translation of the ride vehicle motion system 12 away from the first track 32. After the ride vehicle motion system 12 moves away from the first track 32, the junction between the first ends 40 and the track end 44 is no longer present. In embodiments, the first track 32 and the track element 20 may not be parallel to the ground or along a plane with each other. For example, the relative position of the first track 32 and the track element 20 may be offset from one another to creater a dropping effect when the vehicle 18 transitions from the track element 20 to the first track 32.

Figure 3:
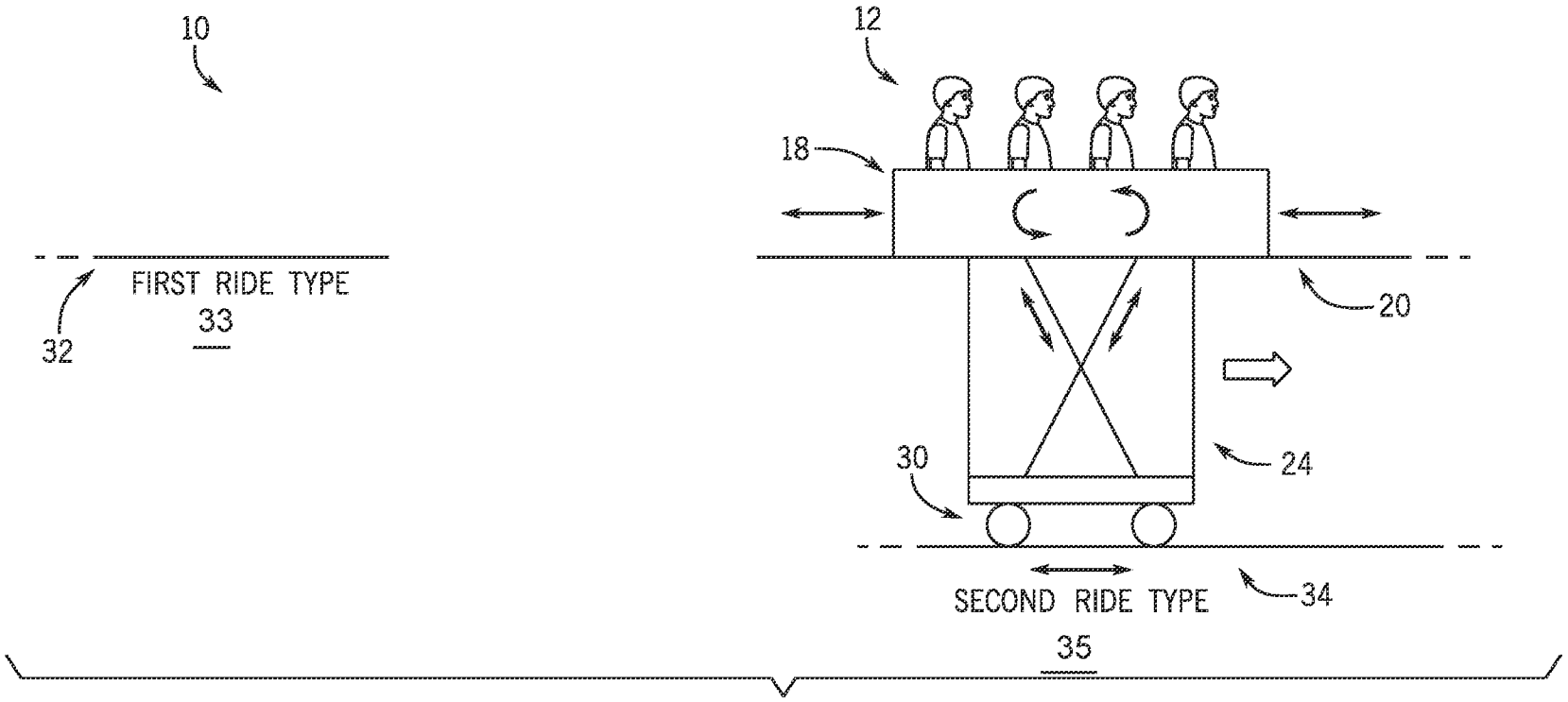
FIG. 3 shows a second configuration of the vehicle motion system of FIG. 1, in accordance with an aspect of the present disclosure.

FIG. 3 is a schematic illustration of a second configuration of the attraction system in which the ride vehicle 18 remains coupled to the ride vehicle motion system 12 during movement of the ride vehicle motion system 12 along the second track 34. It should be understood that, in embodiments, the second configuration may be a trackless arrangement in which the second ride type 35 does not include a track and the transport base drives directly on a trackless surface. In the illustrated arrangement of the second ride type 35, the transport base 30 directly contacts the second track 34, and the ride vehicle 18 does not directly contact the second track 34. In the first configuration or while in the first ride type 33, the ride vehicle 18 is positioned directly on the first track 32. Thus, the first track 32 and the second track 34 (or surface) may be at least partially at different heights or levels in the attraction system 10 to permit the relatively higher ride vehicle 18 to smoothly enter onto the first track 32 and to permit the transport base 30 to traverse the second track 34.

It should be understood that a multi-experience attraction system 10 as provided herein can include both the first ride type 33 and the second ride type 35 as part of a single ride cycle such that guests loaded into the ride vehicle 18 experience both the first ride type 33 and the second ride type 35 during the attraction. As generally discussed herein, the first ride type 33 and the second ride type 35 may be different ride configurations. One or both of the first ride type 33 and the second ride type 35 may be a coaster ride, a dark ride, a water ride, an AR/VR ride, etc. Additional ride types may also be incorporated into the attraction system 12, which may include two, three, four, or more ride types. The relative order of the ride types may be the same or different between different ride cycles. In some embodiments, the first ride type 33 can always precede the second ride type 35. In other embodiments, the second ride type 35 may occur before or after the first ride type 33.

Figure 4:
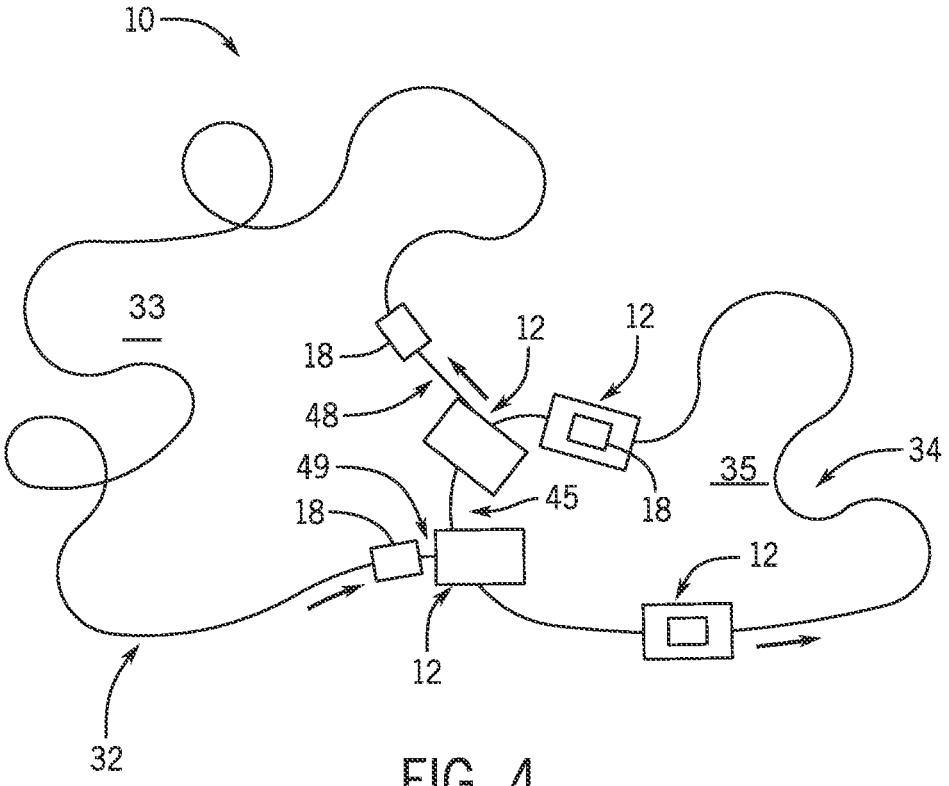
FIG. 4 is a schematic diagram of a multi-experience attraction including a vehicle motion system, in accordance with an aspect of the present disclosure.

In an embodiment, an attraction system 10 as provided herein includes multiple vehicle motion systems 12 distributed throughout the attraction system 10 as shown in FIG. 4. For example, the system 10 may include the first track 32 arranged as a roller coaster track. The ride vehicle motion system 12 can be aligned with an entry point 48 to the track 32 to load the ride vehicle 18 onto the first track 32. The empty or available vehicle motion system 12 can then move away from the entry point 48, e.g., to an exit point 49 of the first track 32, to receive the ride vehicle 18 or a different ride vehicle 18. Once loaded from the exit point 49 onto the ride vehicle motion system 12, the ride vehicle motion system 12, including the ride vehicle 18, can traverse the second track 34 to experience a second ride type 35. The second track 34, or surface can intersect with the entry point 48 and/or exit point 49 to link the first track 32 and the second track 34. The attraction system 10 may also include in-line or separate vehicle loading areas to exchange guests in between ride cycles.

In the example of FIG. 4, certain vehicle motion system 10 are "empty" and include an available vehicle slot 45 within the attraction system 12 while other vehicle motion systems 12 are "loaded" and include the ride vehicle 18. Thus, the attraction system 10 can include a mix of configurations for the vehicle motion systems 12. In an embodiment, the ride vehicle motion system 12 is loaded while traversing the second track 34 or surface. The second track 34 can be designed to operate in conjunction with motion effects for the ride vehicle 18 that are provided by or generated by the onboard motion base 24 of the ride vehicle motion system 12. The ride vehicle motion system 12 can be empty after loading their vehicles 12 onto the first track 32. Once empty, the ride vehicle motion system 12 can move to the exit point 49 of the first track 32 to receive an incoming ride vehicle 18. The ride vehicle motion system 12 can receive the same or different ride vehicle 18.

Figure 5:
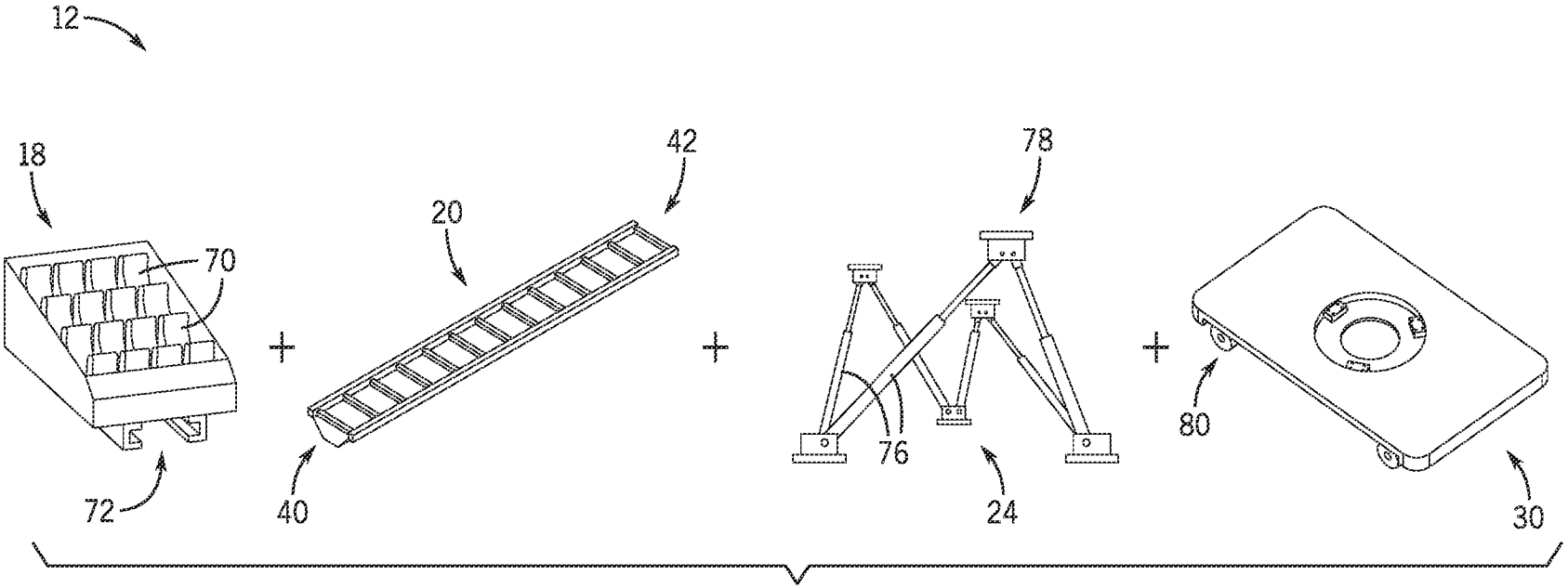
FIG. 5 is a component view of a vehicle motion system, in accordance with an aspect of the present disclosure.

FIG. 5 is an exploded view of components of the ride vehicle motion system 12. The ride vehicle 18 may include multiple seats 70 to accommodate multiple guests and can be arranged to be compatible with different experiences (e.g., a first ride type 33 and a second ride type 35) of a multi-experience attraction system as provided herein. In the illustrated example, the ride vehicle 18 includes a coupling system 72, e.g., a pinch system, that couples the ride vehicle to the track element 20. The coupling system 72 also permits the ride vehicle 18 to move between the first end 40 and the second end 42 of the track element 20. In embodiments, the ride vehicle 18 may move backwards and/or forwards along the track element 20.

For example, the ride vehicle 18 may move along the track element 20 to load the ride vehicle 18 onto the first track 32. The ride vehicle 18 may initiate the movement before the alignment of the first end 40 or the second end 42 of the track element 20 with the first track 32. The ride vehicle 18 can be controlled to be in motion at the moment of the alignment to maintain a substantially constant speed onto and around the first track 32. In another example, the ride vehicle 18 may move along the track element 20 as part of motion effects while moving along the second track 34 or as part of a second ride type 35. The track element 20 can be longer than the ride vehicle 18 to permit lateral movement. In an embodiment, the track element 20 is at least twice as long as a length of the ride vehicle 18 by way of example. However, other arrangements are also contemplated.

The ride vehicle motion system 12 also includes the motion base 24, illustrated here as a six degree of freedom motion system 76 with linear actuators by way of example. The motion system 76 can be coupled to a plate or platform at actuator ends 78, which in turn can couple to the track element 20. Thus, the motion of the motion base 24 is translated to the track element 20. The motion base 24 is supported by the transport base 24, which can be a wheeled base or cart 80. The ride vehicle motion system 12 is capable of activating the motion base 24 while in motion. Thus, the ride vehicle motion system 12 may include an onboard power source. In some cases, the ride vehicle motion system 12 can receive power from the second track 34 or surface via contact with the transport base 30.

As discussed herein, the ride vehicle 18 is capable of separating from the ride vehicle motion system 18, while the track element 20, the motion base 24, and the transport base 30 remain coupled to one another, e.g., fixedly coupled or attached, within the attraction system 10.

Figure 6:
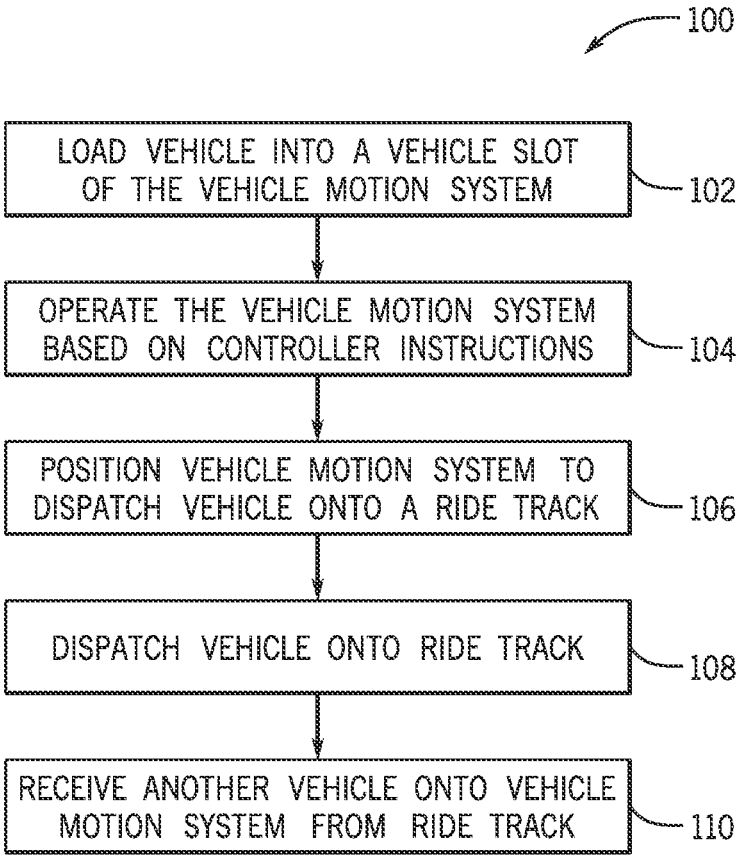
FIG. 6 is a flow diagram of a vehicle motion system operation technique, in accordance with an aspect of the present disclosure.

FIG. 6 is a flow diagram illustrating an embodiment of a method 100 of operation of a multi-experience attraction, e.g., the attraction system 10. Certain operations of the method may be executed using one or more processor-based controllers executing instructions stored in a memory (see FIG. 8). In the illustrated embodiment, the method 100 initiates with loading of a ride vehicle 18 into an available vehicle slot 45 of the ride vehicle motion system 12 (block 102). For example, the ride vehicle 18 can be exiting from the first track 32. In another example, the ride vehicle 18 can be loaded as part of a passenger loading process. Once loaded, the ride vehicle motion system 12 can be operated based on controller instructions (block 104). For example, an attraction controller can generate instructions that are executed by various subcontrollers of the ride vehicle motion system 12 to cause the ride vehicle motion system 12 to move within the attraction system 10, e.g., along a predetermined path of the second track 34 or surface. At various points along the path, the motion base 24 can be activated according to preprogrammed instructions to cause motion effects at specific time points and/or at specific locations within the attraction system 10 as part of the ride experience. In certain cases, the motion effects may be responsive to guest actions or inputs and can be variable between rides.

After the ride vehicle motion system 12 has completed the path, the attraction system 10 can transition the ride vehicle between ride types by loading the ride vehicle 18 onto a track associated with a different ride. The ride vehicle motion system 12 can, under controller instructions, move to be aligned with the ride track (block 106). Once the ride vehicle 18 is in position, the attraction system 10 can control the vehicle motion to dispatch the ride vehicle 18 onto the ride track (block 108). In some cases, the alignment can be facilitated by both positioning the ride vehicle motion system 12 so that the track element 20 is adjacent to the ride track (e.g., the first track 32) and activating the motion base 24 to perform fine alignment to create a junction between the track element 20 and the ride track. The empty ride vehicle motion system 12 is then available to receive another ride vehicle 18 from the ride track (block 110).

Figure 7:
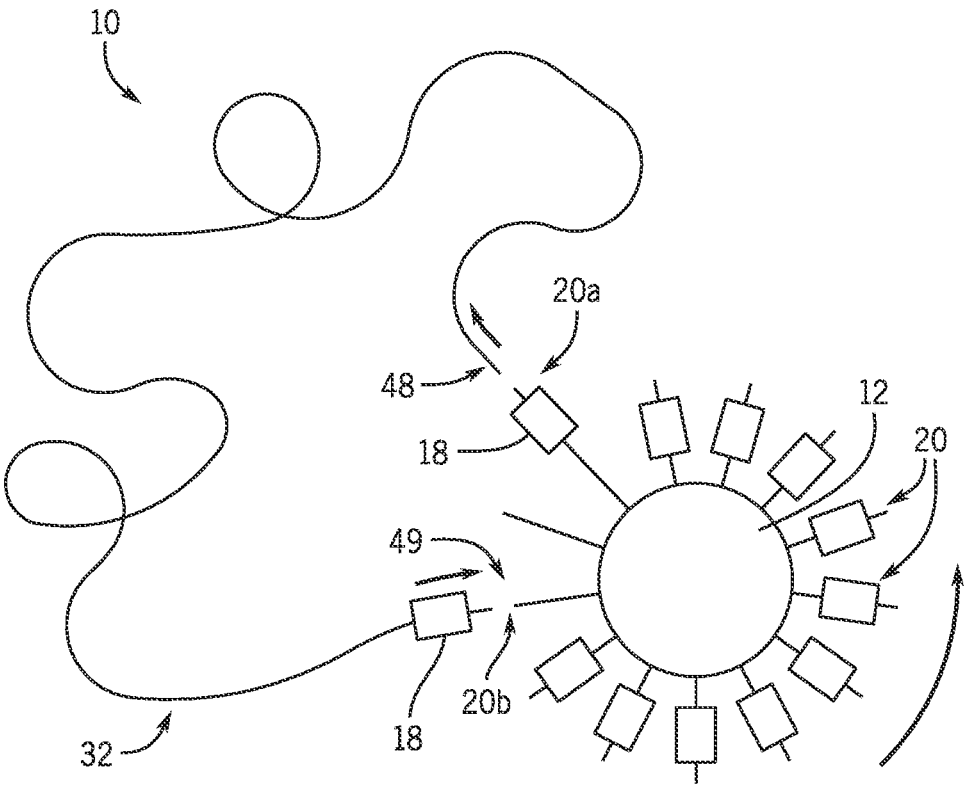
FIG. 7 is a schematic diagram of a multi-experience attraction including a vehicle motion system, in accordance with an aspect of the present disclosure.

FIG. 7 is a schematic illustration of an arrangement in which the ride vehicle motion system 12 is a multi-vehicle system, such as a carousel, that can accommodate multiple track elements 20 and multiple ride vehicles 18. Rotation of the ride vehicle motion system 12 can move a portion of the track elements 20 into alignment with the first track 32. For example, the rotation about an axis can move a first track element 20*a* into alignment with an entry point 48 and a second track element 20*b* into alignment with the ride exit point 49. The ride vehicle supported by the first track element 20*a* can be dispatched onto the first track 32, while another ride vehicle 18 can be receiving onto the second track element 20*b* at the exit point 49. The ride vehicle motion system 12 can rotate again to bring the next ride vehicle 18 into alignment for dispatch and to bring the now-empty first track element 20*a* into alignment with the exit point 49 to receive another ride vehicle 18. In this manner, the ride vehicle motion system 12, through rotation and activation of other motion effects, can serve as one ride type, while ride vehicles 18 travelling along the first track experience a different ride type.

Figure 8:
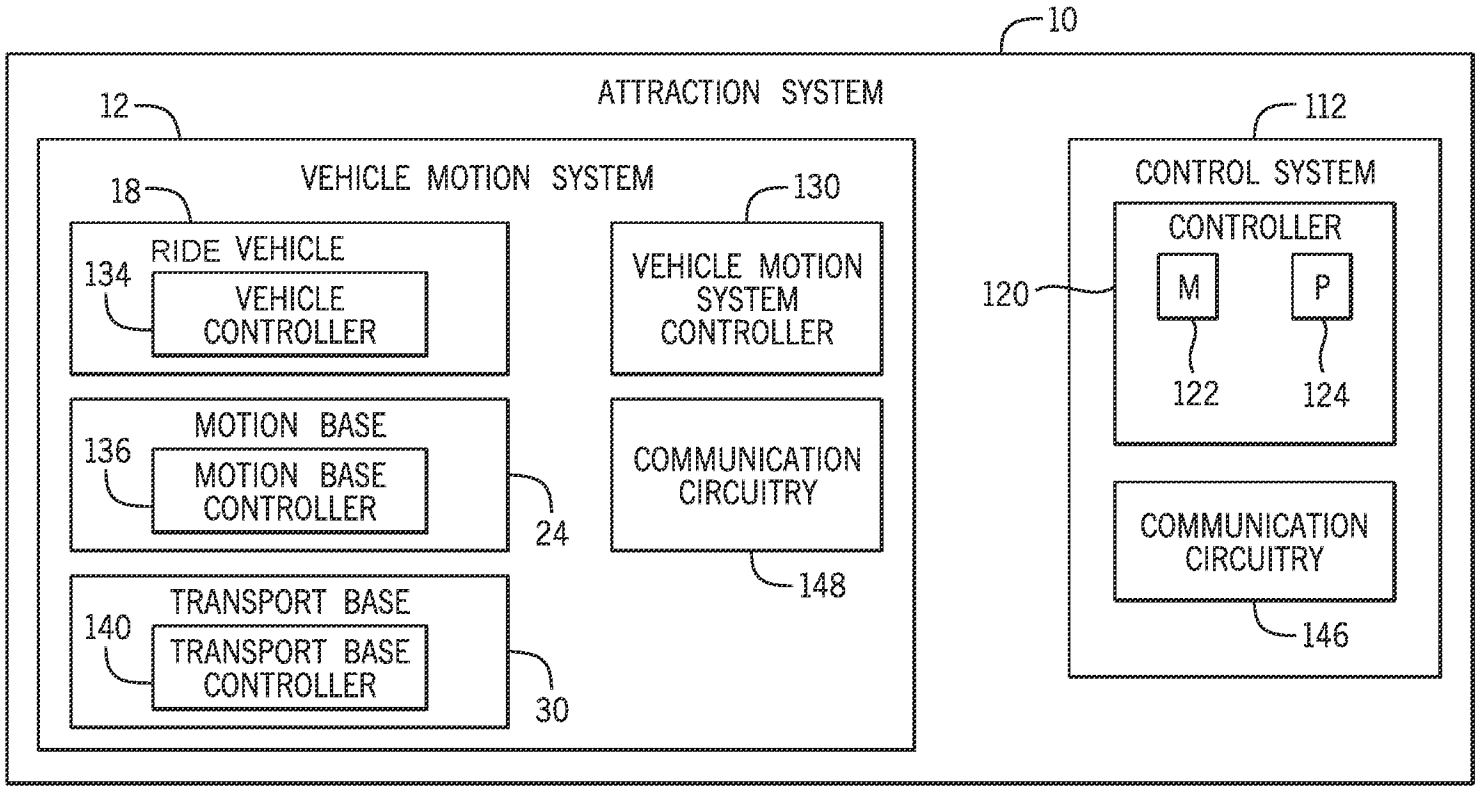
FIG. 8 is a block diagram of an attraction system, in accordance with an aspect of the present disclosure.

FIG. 8 is a block diagram of certain components of the attraction system 10. It should be understood that the illustrated components may have additional software or hardware elements. Further, the functionality of various disclosed hardware or software elements may be duplicated and/or exchanged in the illustrated components.

The system 10 may be configured to operate at least in part via instructions from an attraction control system 112, which may include a controller 120. The controller 120 includes a memory 122 for storing instructions executable by a processor 124 to perform the methods and control actions described herein. The processor 124 may include one or more processing devices, and the memory 122 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium which can be used to carry or store desired program code in the form of machine-executable instructions or data structures and which can be accessed by the processor 124 or by a special purpose or programmed computer or other machine with a processor. Subcomponents of the system 10 may include separate or additional controllers, such as a vehicle motion system controller 130, a vehicle controller 134, a motion base controller 136, and a transport base controller 140. However, in certain embodiments, the functions of one or more of these controllers may be combined. It should be understood that additional controllers as provided herein may include processor and memory circuitry as generally discussed with respect the controller 120.

In addition, the attraction control system 112 may be configured to include communication circuitry, e.g., a transceiver or other communications devices to communicate over wired and wireless communication paths with one or more other components of the system 10. For example, the control system 112 of the attraction system 10 may include communication circuitry 146 that communicates with communication circuitry 148 of the ride vehicle motion system 12 to pass instructions, status information, etc. In one embodiment, communication between components of the system 10 occurs at least in part via a wireless network.

As discussed, the ride vehicle motion system 12 may include a vehicle 18, a motion base 24, and a transport base 30. One or all of these may include a motor and a power source, e.g., a battery, a solar panel, an electrical generator, a gas engine, or any combination thereof. In an embodiment, the vehicle power source may at least in part not necessarily be onboard the ride vehicle motion system 12 and may be transferred to the vehicle from an off-board source such as a bus bar or other power transfer device.

The operations of the motor may be controlled by the appropriate controller, which may include a processor and a memory configured to operate any on-board logic to control execution of the instructions. For example, the vehicle controller 134 may control the motor to adjust its output power to accelerate or decelerate the vehicle 18. The vehicle controller 134 may also control a brake to decelerate or stop the vehicle 18. Further, the vehicle controller 134 may operate under instructions from the rider via a user input interface or user input or from the controller 120, via communications circuitry 146. In another example, the motion base controller 136 may operate under instructions from the controller 120 to cause the motion base 24 to actuate. The transport base controller 140 may operate under instructions from the controller 120 to cause the transport base 30 to move within the attraction system 10.

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An attraction system, comprising:

a ride vehicle motion system, comprising:

a ride vehicle;

a track element supporting the ride vehicle;

a motion base configured to actuate to cause the ride vehicle and the track element to move, wherein the track element is positioned between the ride vehicle and the motion base;

a transport base supporting the motion base, wherein the transport base is configured to transport the ride vehicle, the track element, and the motion base as a unit along a second track or a surface associated with a second ride type;

a vehicle controller configured to maintain a speed of the ride vehicle between the track element and entry onto the second track upon alignment of the track element with the second track; and a first track configured to receive the ride vehicle from the track element, wherein the first track is associated with a first ride type.

2. The system of claim 1, comprising a controller configured to generate instructions to cause the ride vehicle motion system to move along the second track or the surface.

3. The system of claim 2, wherein the controller is configured to cause the ride vehicle motion system to move according to the instructions such that the track element is coupled to the first track at an entry point of the first ride type.

4. The system of claim 3, wherein the controller is configured to cause the ride vehicle to move from the track element onto the first track to leave an available vehicle slot on the track element.

5. The system of claim 4, wherein the controller is configured to cause the ride vehicle motion system to move according to the instructions to couple the track element to the first track at an exit point of the first ride type and to receive the ride vehicle or a different ride vehicle into the available vehicle slot.

6. The system of claim 2, wherein the controller is configured to cause the ride vehicle to move relative to the track element while the ride vehicle motion system moves along the second track or the surface.

7. The system of claim 1, wherein the motion base comprises one or more mechanical, hydraulic, or pneumatic actuators.

8. The system of claim 1, wherein the motion base is fixedly coupled to the track element, the transport base, or both.

9. The system of claim 1, wherein the ride vehicle is configured to rotate independently of and relative to the track element.

10. An attraction system, comprising:

a ride vehicle motion system, comprising:

a plurality of track elements, wherein a track element of the plurality of track elements supports a ride vehicle; and a motion base configured to actuate to cause motion effects for the ride vehicle and to rotate the plurality of track elements about an axis of the motion base such that the ride vehicle and the track element rotate together;

a controller configured to generate instructions to control the motion base; and a track loop configured to;

receive the ride vehicle from the track element at an entry point of the track loop after rotation of the motion base to align the track element with the entry point, wherein, after the rotation, the controller causes the ride vehicle to move along the track element and onto the track loop.

11. The system of claim 10, wherein the track loop is part of a roller coaster ride.

12. The system of claim 10, wherein the motion base is configured as a carousel-type ride.

13. The system of claim 10, wherein the controller is configured to generate instructions to move the ride vehicle relative to the track element while the motion base is rotating.

14. An attraction system, comprising:

a first track associated with a first ride type;

a plurality of ride vehicles;

a plurality of ride vehicle motion systems, each ride vehicle motion system of the plurality comprising:

a track element;

a motion base configured to actuate to cause the track element to move; and a transport base supporting the motion base, wherein the transport base is configured to transport the track element and the motion base as a unit along a second track or a surface associated with a second ride type; and a controller configured to generate instructions to:

cause a first ride vehicle motion system of the plurality of ride vehicle motion systems to move to align the track element with an entry point of the first track;

cause a first ride vehicle of the plurality of ride vehicles to move along the track element and onto the first track while maintaining a speed of the ride vehicle between the track element and entry onto the first track upon alignment of the track element with the first track; and cause a second ride vehicle of the plurality of ride vehicles to move from the first track onto an available vehicle slot of a second ride vehicle motion system of the plurality of ride vehicle motion systems.

15. The system of claim 14, wherein the controller generates instructions to cause an individual ride vehicle motion system of the plurality of ride vehicle motion systems to move along the second track or the surface and wherein the track element of the individual ride vehicle motion system is coupled to a ride vehicle of the plurality of ride vehicles.

16. The system of claim 15, wherein the controller generates instructions to cause the first ride vehicle to move relative to the track element while the first ride vehicle motion system is moving to align the track element with the entry point of the first track.

17. The system of claim 14, wherein the motion base is configured to cause the track element to roll, pitch, heave, yaw, sway, or surge.

18. The system of claim 14, wherein the transport base comprises one or more wheels and wherein the ride vehicle comprises one or more wheels or pinch elements.

* * * * *